United States Patent [19]

Brumfield

[11] Patent Number: 5,044,391

[45] Date of Patent: Sep. 3, 1991

[54] SIPHON ASSEMBLY WITH PRIMING VALVE

[75] Inventor: William B. Brumfield, Richmond, Ky.

[73] Assignee: Si-Flo, Inc., Richmond, Ky.

[21] Appl. No.: 516,320

[22] Filed: Apr. 30, 1990

[51] Int. Cl.[5] ..... F04F 10/00

[52] U.S. Cl. ..... 137/151; 137/146; 137/533.11

[58] Field of Search ..... 137/146, 151, 533.11, 137/533.15

[56] References Cited

U.S. PATENT DOCUMENTS

| | | | |
|---|---|---|---|
| 342,478 | 5/1886 | Tatum | 137/533.11 |
| 412,191 | 10/1889 | Kruse | 137/151 X |
| 608,960 | 8/1898 | Foulois | 137/151 X |
| 2,604,294 | 7/1952 | Tamminga . | |
| 2,927,596 | 3/1960 | Carlson . | |
| 3,011,510 | 12/1961 | Standfird | 137/151 |
| 3,610,263 | 10/1971 | Walters | 137/533.13 X |
| 3,771,544 | 11/1973 | Horvath . | |
| 3,771,556 | 11/1973 | Gifford | 137/533.11 |
| 4,095,615 | 6/1978 | Ramsauer . | |
| 4,286,622 | 9/1981 | Ninomiya et al. | 137/533.11 |
| 4,414,997 | 11/1983 | Jacobson et al. | 137/146 X |
| 4,574,828 | 3/1986 | Brumfield | 137/151 X |

FOREIGN PATENT DOCUMENTS 59-245 10/1891 Fed. Rep. of Germany ..... 137/151

*Primary Examiner*—Gerald A. Michalsky
*Attorney, Agent, or Firm*—King and Schickli

[57] ABSTRACT

A siphon assembly includes a tube connecting a fluid source with a fluid receiver and a priming valve attached to the source end of the tube. The priming valve includes a body having an inlet port and a neck having an outlet port. The inlet and outlet ports are connected by a flow cavity extending through the body and neck. A valve member comprised of a metal ball is received in a seat near the inlet port of the body. Stop ribs are provided in the flow cavity where the body transitions to the neck to receive and centrally position the ball during siphon flow to provide substantially smooth, rapid fluid flow through the valve during siphoning. The body is comprised of a housing and an end ring attached to the housing. The two-piece body may be assembled by welding or alternatively the housing may have an annular flange on its inner surface that mates with a locking tab on the end ring to provide secure attachment. The end ring is fluted to allow continuous siphon flow when the valve sits flush against a surface of the fluid source.

5 Claims, 1 Drawing Sheet

SIPHON ASSEMBLY WITH PRIMING VALVE

TECHNICAL FIELD

The present invention relates generally to fluid transfer assemblies and more particularly to a siphon assembly with a priming valve that efficiently creates and promotes smooth, rapid fluid flow.

BACKGROUND OF THE INVENTION

Many situations arise that require the transfer of fluids from one point to another. This can be quickly and easily accomplished using motorized pumps to generate the transferring force. However, there are many instances where electric pumps are not available or are not adapted to be used in the particular environment. In these particular situations, siphons are commonly used to accomplish the transfer of fluid.

Siphons generally include a tube that is used to transfer fluid to a lower level along a path including an intervening portion of relatively higher elevation. Once the fluid in the tube reaches the peak of the elevation, its weight (associated with the force of gravity) generally provides the impetus to create a continuous flow due to the elevational difference between the fluid source and receiver. The main difficulty is to get the fluid from the source through the portion of the tube that climbs the elevation. The common use of siphons often involves the user sucking on the outlet end of the tube to draw the liquid to the point in the tube where the force of gravity takes over. This procedure is not only time-consuming and tiresome but can also be hazardous when the transferred fluid is a dangerous substance such as gasoline or the like which is not to be ingested.

Improvements to siphon assemblies have included the provision of a valve device on the source end of the siphon tube. One such device is disclosed in U.S. Pat. No. 4,414,997 to Jacobson et al. The valve assembly includes a valve body with inlet and outlet ports connected by a flow cavity. A cup-shaped valve member is receivable within a valve seat formed in the inlet end of the body. The valve member oscillates within the flow cavity between its seated position and an unseated position when the siphon assembly is shaken up and down. When the valve element is in the seated position, fluid is prevented from flowing around it and through the valve body out of the siphon tube. Alternatively, when the valve element is in the unseated position, fluid is allowed to flow around it and through the valve body into the siphon tube. Once a sufficient amount of fluid has entered the tube, gravity generates continuous siphon flow.

The Jacobson valve assembly allows the user to generate siphon flow without the user having to suck on the outlet end of the siphon tube. More particularly, the valve assembly is shaken in an up and down manner to gradually force the fluid into the siphon tube and up the elevation to the critical point where gravity takes over. As the valve assembly is moved in the downward direction during priming, fluid forces the valve member to an unseated position and fluid is allowed to flow around the member into the siphon tube. When the assembly is moved in the upward direction, the valve member is urged into the seated position, preventing the fluid already in the siphon tube from escaping. Continuous up and down movement forces the fluid higher and higher in the siphon tube until it reaches the critical point where the force of gravity creates continuous siphon flow.

While this valve assembly has proven effective in many applications, it is not without its drawbacks. When in the unseated position, the valve member occupies a substantial amount of the volume within the flow cavity. In addition, the available flow area leading to the siphon tube as the valve member sits against the upper inner flange of the valve body next to the flared portion of the flow cavity is limited. Both of these design aspects tend to partially restrict the fluid flow and under certain conditions create problems relating to turbulence at various points within the flow cavity, resulting in irregular and slower flow. Further, if the valve assembly comes to rest upright on the bottom surface of the fluid source, the inlet port is completedly blocked, substantially halting the fluid flow that has been created.

A need is therefore fully identified for an improved siphon assembly and more particularly an improved priming valve that not only functions to efficiently generate continuous siphon flow but also allows smooth and rapid flow around the valve element and through the valve body. Such a siphon assembly would allow the user to create continuous siphon flow without having to suck on the outlet end of the siphon tube and prevent the need to constantly monitor the siphon operation.

SUMMARY OF THE INVENTION

Accordingly, it is a primary object of the present invention to provide a siphon assembly and priming valve for a siphon assembly overcoming the above-described limitations and disadvantages of the prior art.

An additional object of the present invention is to provide a priming valve for use in a siphon assembly that maximizes the flow area within the flow cavity while maintaining optimum flow dynamics to allow smooth, rapid siphon flow.

Another object of the present invention is to provide a priming valve for a siphon assembly that allows continuous flow while the inlet port of the valve rests flush against a surface of the fluid source.

Yet another object of the present invention is to provide a priming valve for a siphon assembly that positively and centrally positions the valve member so as to assist in smooth, rapid siphon flow.

An additional object of the present invention is to provide a siphon assembly and a priming valve for a siphon assembly that generates continuous siphon flow without the user having to suck on the outlet end of the siphon tube and without direct contact between the user and the fluid.

Still another object of the present invention is to provide a siphon assembly and a priming valve for a siphon assembly that has a minimum number of components and is easy and economical to make and use.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved siphon assembly is provided. The siphon assembly includes a flexible siphon tube that connects a fluid source with a fluid receiver. In order to obviate the need to suck on the outlet end of the tube to draw the fluid into the tube, a priming valve is attached to the source end of the tube. The priming valve allows siphon flow to be created by manipulation of the assembly from a position remote from the fluid while eliminating the hazards associated with the possible swallowing of a dangerous fluid.

The priming valve includes a body having an inlet port. The body is integral with a neck of reduced diameter. The siphon tube is forced onto and around the outer surface of the neck. The neck includes an outlet port that leads into the siphon tube. A flow cavity through the body and neck connects the inlet and outlet ports. A valve member is positioned within the flow cavity and reciprocates between a proximal or inlet end and a distal or outlet end of the body. Preferably, the valve member is a metal ball of sufficient mass so as to be capable of displacing fluids having a variety of densities. The ball is receivable in a seat located at the proximal end of the body. When the ball is in the seated position, it prevents fluid from flowing around it and thus into or out of the body.

In an important aspect of the invention, the body is provided with stop ribs at its distal end within the flow cavity. Once siphon flow has been started, the ball is positively received and centrally positioned by the ribs to assist in smooth fluid flow through the body and ultimately through the siphon tube. More particularly, the ribs advantageously position the ball centrally between the side walls of the body to allow fluid to flow around the entire outer surface of the ball. In addition, the ribs space the ball from the outlet end of the body, generally half-way along its longitudinal extent. The central positioning of the ball by the ribs assists in providing optimal flow dynamics for the fluid flow. The use of a ball as the valve member also allows the maximization of the flow area within the flow cavity to further bring about smooth, rapid siphon flow.

The body of the priming valve includes a housing and an end ring attached to the housing. In the preferred embodiment, the housing includes an annular flange on its inner surface that mates with an annular locking tab formed on the end ring to provide a positive and secure attachment for the two components. Thus, once the ball is inserted in the housing and the end ring is thereafter attached, it is substantially impossible to disassemble the priming valve, assuring its integrity in the working environment. Alternatively, the housing and the end ring may be attached using other commonly known methods such as welding.

In accordance with a further aspect of the present invention, the inlet end of the priming valve is provided with a plurality of rounded grooves, i.e. flutes, to assure continuous siphon flow. More particularly, after continuous siphon flow has been created, the priming valve may intentionally or unintentionally come to rest or be forced to a position flush against a surface of the fluid source. In prior art valve assemblies without the flutes, this situation often resulted in the complete cut-off of fluid flow, disrupting the operation of the siphon assembly. The provision of flutes in the inlet end of the body of the present invention advantageously provides for continuous siphon flow when, for instance, the priming valve comes to rest on the bottom surface of the fluid source. This feature prevents the need for the user to provide constant oversight of the siphon operation in anticipation of restarting the siphon flow following the inadvertent disruption of operation.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Figure 1:
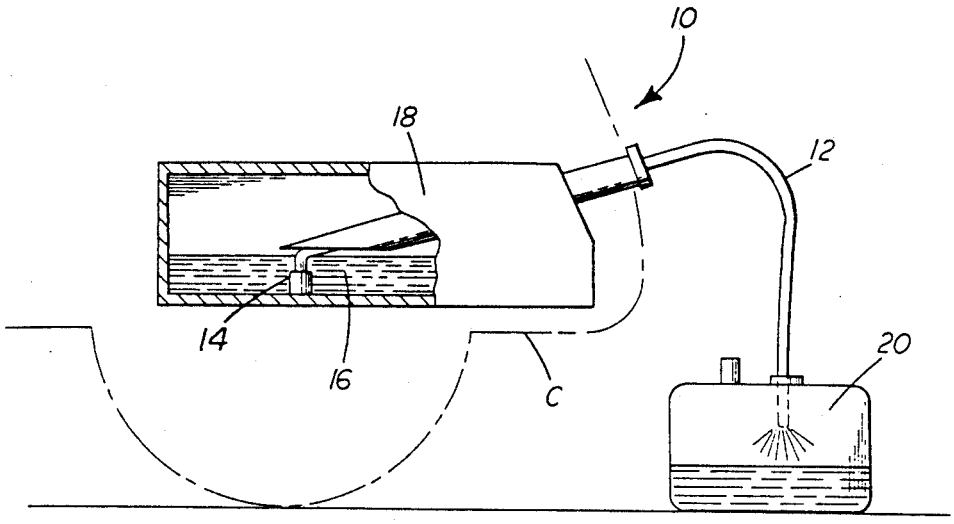
FIG. 1 is a partial side elevational cutaway view showing the siphon assembly of the present invention in use siphoning gasoline from an automobile gas tank.

Reference will now be made in detail to the present preferred embodiment of the invention, an example of which is illustrated in the accompanying drawing.

DETAILED DESCRIPTION OF THE DRAWING

Reference is now made to FIG. 1 of the drawing showing the improved siphon assembly 10 of the present invention in the working environment. The siphon assembly 10 of the present invention is particularly beneficial in transferring fluids such as gasoline that present substantial health hazards if swallowed. More specifically, siphoning action may be established by simple reciprocation of the assembly, thereby eliminating any need for an individual to suck on the end of the siphoning tube. Accordingly, it should be appreciated that the siphon assembly 10 is suitable for use in a wide variety of applications requiring the transfer of fluid.

The siphon assembly 10 includes a flexible siphon tube 12 and a priming valve 14. The valve 14 is attached to the end of the tube 12 that is placed in the fluid 16 situated in the fluid source 18 (such as the gasoline tank of an automobile C in FIG. 1). The siphon assembly 10 acts to transfer the fluid 16 from the source 18 to a fluid receiver 20.

The priming valve 14 includes a body 22 integral with a neck 24 of reduced diameter. The body 22/neck 24 assembly is preferably made of durable, corrosion resistant plastic that enables its use in a wide variety of working environments. The transition site between the body 22 and neck 24 defines a shoulder 26. The tube 12 of the assembly 10 is forced onto and securely surrounds the neck 24 and rests against the shoulder 26.

The stretched, frictional fit of the tube 12 over the neck 24 prevents fluid within the tube 12 from leaking out around the neck 24.

The body 22 includes an inlet port 28 for the valve 14 and the neck 24 has an outlet port 30 opening into the tube 12. A flow cavity 32 through the valve 14 connects the inlet port 28 and the outlet port 30. The flow cavity 32 thus extends through both the body 22 and the neck 24. There is therefore provided a passage for fluid through the priming valve 14 into the siphon tube 12.

Figure 3A:
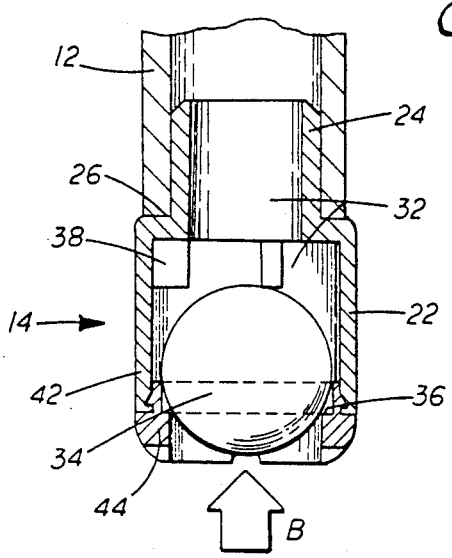
FIG. 3*a* is a cross sectional view of the priming valve showing the ball received in the seat of the body during the priming action.
Figure 3B:
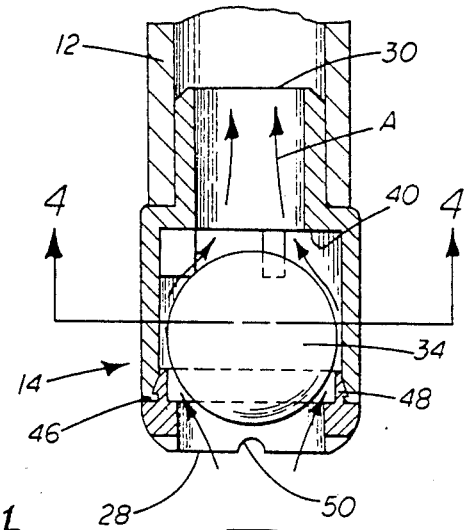
FIG. 3*b* is a view similar to FIG. 3*a* showing the ball resting against the stop ribs in another position during priming action and representing its general position during continuous siphon flow.

Operationally positioned within the body 22 is a ball 34. The ball 34 is preferably made of metal and is of a mass that is sufficient to displace fluids of different densities. Accordingly, the ball 34 is not disposed to float but rather is drawn downward by the force of gravity. When the valve 14 is in stationary upright position, the ball 34 is received within a ball seat 36 at the inlet end of the body 22 (note FIG. 3*a*). When in this position, the ball 34 prevents fluid flow around it into or out of the flow cavity 32. Conversely, when the ball 34 is displaced from the seat 36 as shown in FIG. 3*b*, the fluid is allowed to pass around the ball 34 through the flow cavity 32 as indicated by flow arrows A. This situation occurs both during the priming action and once continuous siphon flow is generated. The force of the fluid being drawn into the tube 12 by the continuous siphon flow is sufficient to force the ball 34 from the seat 36.

In an important aspect of the invention, a plurality of stop ribs 38 are provided in the body 22. More particularly, an annular ridge 40 is defined within the flow cavity 32 where the body 22 transitions to the neck 24. The stop ribs 38 are formed integral with the ridge 40. The ribs 38 extend radially inwardly from the inner surface of the body 22 adjacent the flow cavity 32 towards its center to the edge of the inner surface of the neck 24. Thus the ribs 38 do not extend across the flow cavity 32 further than the neck portion of the flow cavity 32 as shown in FIG. 4.

The preferred embodiment of the valve 14 incorporates three stop ribs 38 spaced equidistantly within the flow cavity 32. It can be appreciated that a greater or lesser number of stop ribs 38 may, however, be provided. The stop ribs 38 advantageously receive and centrally position the ball 34 during continuous siphon flow. The central radial positioning of the ball 34 and the spacing between it and the ridge 40 of the body 22 provided by the ribs 38 are functionally important in providing smooth and continuous siphon flow.

Figure 4:
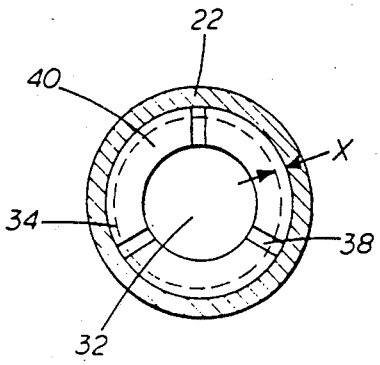
FIG. 4 is a view taken along the lines 4—4 in FIG. 3*b*, showing the ball in phantom.

More particularly, the central radial positioning of the ball 34 allows for an equal volume of fluid to pass at all points between the ball 34 and the inner surface of the body 22 at the narrowest portion of the flow cavity 32 (indicated by the gap x between the ball 34 and the body 22 shown in FIG. 4). This tends to substantially reduce the turbulence associated with uneven flow around the ball 34. The longitudinal positioning of the ball 34 against the ribs 38 also substantially eliminates problems associated with flow restriction within the flow cavity 32 as the body 22 transitions to the neck 24. In addition, the use of a ball 34 as the valve element acts to maximize the flow area within the flow cavity 32 while cooperatively assisting in allowing smooth flow therethrough. Accordingly, the design of the present invention advantageously enhances the flow dynamics of the fluid, resulting in smooth and rapid siphoning action.

The body 22 is preferably comprised of a housing 42 and an end ring 44. The end ring 44 preferably provides the site for the ball seat 36. During assembly of the priming valve 14, the ball 34 is inserted within the housing 40 and then the end ring 42 is securely attached to positively and permanently retain the ball 34 within the body 22.

In the preferred embodiment, the housing 40 is provided with an annular flange 46 that cooperatively mates with a locking tab 48 formed on the end ring 44. The locking tab 48 is provided with a taper that allows it to advantageously slightly deform as the end ring 44 is pressed onto the housing 42. Once the locking tab 48 passes the annular flange 46, it snaps into locking position. Thus assembled, the priming valve 14 is ready to be attached to the siphon tube 12 and can operate in a working environment without fear of coming apart while in use. While the positive locking assembly described above is the preferred mechanism for securing the housing 42 and end ring 44 together, it should be appreciated, however, that other commonly known attachment methods may be used, such as gluing or welding.

Figure 2:
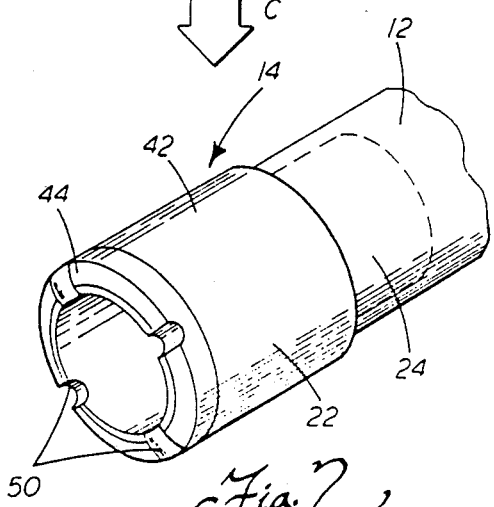
FIG. 2 is a perspective view of the priming valve of the present invention attached to a siphon tube.

In accordance with a further aspect of the invention, rounded grooves or flutes 50 are provided in the end ring 44. As shown in FIG. 2, there are four flutes 50 provided at spaced quadrantal positions on the end ring 44. It can be appreciated that a fewer or greater number of flutes 50 may be provided. The flutes 50 function to provide a series of passages allowing siphon flow to continue once generated even if the priming valve 14 is placed flush against a surface of the fluid source 18, such as in an upright position on the bottom surface as shown in FIG. 1. It can be visualized that absent the flutes 50, the inlet port 28 of the body 22 is blocked when the priming valve 14 is positioned as shown. Accordingly, the fluid 16 would be prevented from continuously flowing through the flow cavity 32 and siphon flow would be disrupted. The flutes 50 prevent this type of siphon flow disruption and thus obviate the need for the user to continuously oversee the siphon operation.

In operation, the priming valve 14 of the siphon assembly 10 is inserted in the fluid 16 of the fluid source 18. As shown in FIG. 1, the fluid 16 must generally travel up an elevation to a maximum point before turning downward to flow to the fluid receiver 20 at a lower elevation than the fluid source 18. In order to force the fluid 16 up the elevation, the priming valve 14 is shaken up and down as indicated by action arrows B and C in FIGS. 3*a* and 3*b* to incrementally force the fluid 16 up the siphon tube 12. This up and down shaking motion defines the priming action of the valve 14.

More particularly, as the priming valve 14 is moved downwardly as shown in FIG. 3*b*, the ball 34 is displaced from the seat 36 and fluid 16 is allowed to pass around it through the flow cavity 32 (note flow arrows A) into the siphon tube 12. Thus, an additional volume of fluid 16 enters the siphon tube 12 during the downward motion C of the priming action.

As the priming valve is moved upwardly during priming (note action arrow B), the ball 34 is forced against the seat 36, preventing the fluid 16 within the tube 12 from escaping. Thus, as the priming valve 14 is continuously shaken, the fluid 16 incrementally is drawn up the elevation of the tube 12 until it reaches the apex position of the tube 12. As the fluid passes this point, it is drawn naturally into the receiver 20 by the force of gravity. Once this occurs, continuous siphon flow is generated and no further shaking of the priming valve 14 is required.

In summary, numerous benefits have been described which result from employing the concepts of the present invention. Advantageously, the siphon assembly 10 and more particularly the priming valve 14 of the present invention provide a number of unique and desirable advantages. Continuous siphon flow is created without the user having to suck on the outlet end of the siphon tube 12, eliminating any hazard associated with the inadvertent ingestion of the transferred fluid. The use of the stop ribs 38 to centrally position the ball 34 within the flow cavity 32 assists in providing smooth, rapid siphon flow into the siphon tube 12. The ribs further act to space the ball 34 from the ridge 40 of the body 22 to further assist in unrestricted siphon flow. The flutes 50 provided in the end ring 44 allow the valve 14 to be positioned flush against a surface of the fluid source 18 without disrupting the continuous siphon flow. Accordingly, the user can easily and efficiently generate siphon flow using the priming valve 14 and does not need to provide constant oversight over the siphon flow once the operation has begun.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An assembly for siphoning fluid from a fluid source into a fluid receiver, comprising:

tube means providing fluid communication between said fluid source and said fluid receiver;

priming means connected to said tube means, said priming means including body means having an inlet port leading to a flow cavity and neck means for receiving said tube means, said flow cavity connecting said inlet port with said tube means;

said body means having a housing and an end ring attached to said housing;

said body means and said neck means meeting at a transition surface oriented in substantially perpendicular relation to said body and said neck means;

valve means within said body means, said valve means including a ball receivable in a cooperating seat;

positioning means integral with said body means, said positioning means extending from the transition surface to a point less than midway toward said inlet port and serving to both radially and longitudinally centrally position said valve means in said flow cavity during siphoning so as to provide smooth rapid fluid flow through said body means;

said positioning means including a plurality of ribs attached at an end of said body means;

passage means for providing continuous fluid flow even while said inlet port of said priming means rest flush against a surface of said fluid source; and an annular flange on an inner surface of said housing and a cooperating locking tab on said end ring, said annular flange and locking tab mating to form a positive and secure attachment, whereby siphon flow is actuated by shaking said assembly.

2. The siphon assembly as in claim 1, wherein said passage means includes a plurality of radially extending grooves formed in said body means adjacent said inlet port.

3. A priming valve for attachment to a siphon tube, comprising:

body means having an inlet port leading to a flow cavity, said body means including a housing and an end ring attached to said housing;

neck means for receiving said siphon tube, said neck means having an outlet port, said body means and said neck means meeting at a transition surface oriented in substantially perpendicular relation to said body means and said neck means;

valve means within said body means, said valve means including a ball receivable in a cooperating seat;

positioning means integral with said body means extending from the transition surface to a point less than midway toward said inlet port and serving to both radially and longitudinally centrally position said valve means in said flow cavity during siphoning so as to provide smooth, rapid fluid flow through said body means;

said positioning means including a plurality of ribs attached to an end of said body means;

passage means for providing continuous fluid flow even while said inlet port of said priming valve rests flush against a surface of a fluid source; and an annular flange on an inner surface of said housing and a cooperating locking tab on said end ring, said annular flange and locking tab mating to form a positive and secure attachment, whereby siphon flow is actuated by shaking said assembly.

4. The priming valve as in claim 3, wherein said passage means includes a plurality of radially extending grooves formed in said body means adjacent said inlet port.

5. The priming valve as in claim 4, wherein said grooves have a rounded surface.

* * * * *